US010669124B2

(12) United States Patent
Copeland et al.

(10) Patent No.: US 10,669,124 B2
(45) Date of Patent: Jun. 2, 2020

(54) ELEVATOR SYSTEM INCLUDING A PROTECTIVE HOISTWAY LINER ASSEMBLY

(71) Applicant: OTIS ELEVATOR COMPANY, Farmington, CT (US)

(72) Inventors: George Scott Copeland, Wethersfield, CT (US); Patricia Derwinski, Farmington, CT (US); Richard K. Pulling, Avon, CT (US); Randy Roberts, Hebron, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 342 days.

(21) Appl. No.: 15/482,103

(22) Filed: Apr. 7, 2017

(65) Prior Publication Data

US 2018/0290862 A1 Oct. 11, 2018

(51) Int. Cl.
*B66B 11/00* (2006.01)
*B66B 7/06* (2006.01)

(52) U.S. Cl.
CPC ..... *B66B 7/06* (2013.01)

(58) Field of Classification Search
CPC ..... B66B 7/06; B66B 7/068; B66B 7/08
See application file for complete search history.

(56) References Cited

U.S. PATENT DOCUMENTS 4,079,816 A * 3/1978 Ohta ..... B66B 7/06 174/42
4,117,908 A * 10/1978 Nara ..... B66B 7/06 187/254

(Continued)

FOREIGN PATENT DOCUMENTS

CN 1642838 A 7/2005
CN 101058382 A 10/2007

(Continued)

OTHER PUBLICATIONS

JP2001316058—Machine Translation (2001).*

(Continued)

*Primary Examiner* — Michael A Riegelman
(74) *Attorney, Agent, or Firm* — Carlson, Gaskey & Olds

(57) ABSTRACT

An illustrative example elevator system includes a hoistway that establishes a vertical pathway. The hoistway has an interior border established by a plurality of stationary boundaries that each have a height aligned with a vertical length of the hoistway. Each of the stationary boundaries has a width generally perpendicular to the height. An elevator car is within the hoistway. At least one vertically extending load bearing assembly includes a plurality of elongated load bearing members extending along a vertical path and facilitating movement or support of the elevator car. At least one hoistway liner assembly is situated in the hoistway. The hoistway liner assembly includes a plurality of bumpers that each have an axis that is generally perpendicular to the vertical length of the hoistway. The axes of at least two of the bumpers are non-parallel. The bumpers collectively establish a protected area sufficient for preventing contact between the load bearing assembly and the interior border of the hoistway if there is lateral movement of any of the load bearing members relative to the vertical path in at least two generally perpendicular directions.

23 Claims, 4 Drawing Sheets

(56) References Cited

U.S. PATENT DOCUMENTS

| | | | | |
|---|---|---|---|---|
| 4,460,065 | A * | 7/1984 | Saxer | B66B 7/06 187/278 |
| 5,025,893 | A * | 6/1991 | Saito | B66B 7/06 187/266 |
| 5,103,937 | A * | 4/1992 | Robertson | B66B 7/06 174/42 |
| 5,509,503 | A * | 4/1996 | Salmon | B66B 11/08 187/266 |
| 5,861,084 | A * | 1/1999 | Barker | B66B 7/06 187/264 |
| 5,947,232 | A * | 9/1999 | Traktovenko | B66B 7/06 187/411 |
| 6,488,125 | B1 * | 12/2002 | Otsuka | B66B 7/068 187/254 |
| 9,067,761 | B2 * | 6/2015 | Ropponen | B66B 7/06 |
| 9,359,172 | B2 | 6/2016 | Mangini et al. | |
| 2005/0133312 | A1 * | 6/2005 | Kaczmarek | B66B 7/068 187/266 |
| 2010/0065381 | A1 * | 3/2010 | Roberts | B66B 7/06 187/401 |
| 2013/0048438 | A1 * | 2/2013 | Mangini | B66B 7/06 187/414 |
| 2013/0133983 | A1 * | 5/2013 | Mangini | B66B 7/06 187/277 |
| 2014/0224590 | A1 * | 8/2014 | Puranen | B66B 5/022 187/247 |
| 2015/0166304 | A1 * | 6/2015 | Roberts | B66B 5/022 187/278 |
| 2016/0017708 | A1 * | 1/2016 | Cao | B66B 17/00 187/408 |

FOREIGN PATENT DOCUMENTS

| | | | |
|---|---|---|---|
| CN | 101343010 | A | 1/2009 |
| CN | 102811936 | A | 12/2012 |
| CN | 103935865 | A | 7/2014 |
| CN | 203845623 | U | 9/2014 |
| CN | 104276481 | A | 1/2015 |
| CN | 104310161 | A | 1/2015 |
| JP | 2766946 | B2 | 6/1998 |
| JP | 2001316058 | A | 11/2001 |
| JP | 2004059211 | A | 2/2004 |
| JP | 2005170655 | A | 6/2005 |
| JP | 2007119131 | A | 5/2007 |
| JP | 4208425 | B2 | 1/2009 |
| JP | 4776281 | B2 | 9/2011 |
| JP | 4910573 | B2 | 4/2012 |
| JP | 2014162587 | A | 9/2014 |
| JP | 2014227291 | A | 12/2014 |
| JP | 2015134654 | A | 7/2015 |
| KR | 20100008668 | U | 9/2010 |
| WO | 2006038397 | A1 | 4/2006 |
| WO | 2009116985 | A1 | 9/2009 |
| WO | 2015013684 | A2 | 1/2015 |
| WO | 2016027298 | A1 | 2/2016 |

OTHER PUBLICATIONS

Extended European Search Report for Application No. EP 18 16 6125 dated Oct. 9, 2018.

First Office Action for CN Application No. 201810314032.7 dated Aug. 14, 2019.

* cited by examiner

ELEVATOR SYSTEM INCLUDING A PROTECTIVE HOISTWAY LINER ASSEMBLY

BACKGROUND

Elevator systems include a machine for moving the elevator car vertically through a hoistway. Different types of machine arrangements are useful for different building configurations. Taller buildings and high rise buildings often include a traction-based machine arrangement and a roping assembly for suspending the elevator car and a counterweight. The machine causes movement of the roping assembly to cause desired movement of the elevator car.

The roping assembly in a traction based elevator system follows a designed pathway based upon the location of sheaves within the hoistway. In taller buildings, the length of the roping assembly combined with the ability of a building to move in response to high wind, thermal or earthquake conditions introduces the possibility for undesired movement of the roping assembly out of the designed path. A variety of sway mitigation devices have been proposed to address situations, such as an earthquake, when there is lateral movement of the roping assembly. Many such devices are designed to be retracted out of the pathway of the elevator car and selectively moved into a position to contact the roping assembly to reduce roping sway. Another type of sway mitigation approach utilizes "car followers" which are roped carriages that are 2:1 roped devices that are pulled up and reside under the car to limit compensation rope motions. These add weight to the machine and ropes which are undesirable limitations.

Ultra-high rise buildings introduce further complexities because there may be static deflection or drift of the building, which includes a steady-state deflection, in addition to building sway, which includes motion such as oscillation. Some previously proposed sway mitigation devices may not be useful for such drift conditions because the device has to move into the pathway of the elevator car to be effective. Additionally, the condition of the roping assembly may be such that the sway mitigation device is unable to have an effect on the position of the roping assembly based on the manner in which the sway mitigation device is situated within the hoistway.

It is necessary to provide protection for an elevator roping assembly in buildings, such as ultra-high rise buildings, where there may be static building drift that introduces the potential for damage to the roping assembly or interference with normal elevator system operation.

SUMMARY

An illustrative example elevator system includes a hoistway that establishes a vertical pathway. The hoistway has an interior border established by a plurality of stationary boundaries that each have a height aligned with a vertical length of the hoistway. Each of the stationary boundaries has a width generally perpendicular to the height. An elevator car is within the hoistway. At least one vertically extending load bearing assembly includes a plurality of elongated load bearing members extending along a vertical path and facilitating movement or support of the elevator car. At least one hoistway liner assembly is situated in the hoistway. The hoistway liner assembly includes a plurality of bumpers that each have an axis that is generally perpendicular to the vertical length of the hoistway. The axes of at least two of the bumpers are non-parallel. The bumpers collectively establish a protected area sufficient for preventing contact between the load bearing assembly and the interior border of the hoistway if there is lateral movement of any of the load bearing members relative to the vertical path in at least two generally perpendicular directions.

In an embodiment having one more features of the elevator system of the previous paragraph, the protected area surrounds the load bearing assembly, the load bearing assembly may move laterally within the protected area toward the interior border of the hoistway, and the protected area is smaller than a hoistway area defined by the interior border of the hoistway.

In an embodiment having one more features of the elevator system of any of the previous paragraphs, the bumpers comprise rollers.

In an embodiment having one more features of the elevator system of any of the previous paragraphs, the rollers comprise a compressible material that absorbs at least some of an impact associated with contact between the load bearing assembly and a contacted one of the rollers.

In an embodiment having one more features of the elevator system of any of the previous paragraphs, the rollers comprise at least one of rubber and polyurethane.

In an embodiment having one more features of the elevator system of any of the previous paragraphs, the bumpers respectively have an effective thickness that establishes a distance between an interior of the barrier established by the hoistway liner assembly and a respective one of the walls, the bumpers respectively have a bumper width that is generally perpendicular to the bumper thickness, and the bumper width of at least one of the bumpers is approximately equal to a difference between the width of one of the walls and the thickness of at least one of the bumpers.

In an embodiment having one more features of the elevator system of any of the previous paragraphs, the hoistway liner assembly includes a plurality of mounting brackets that support the bumpers in respectively selected vertical locations, and the effective thickness is based on a dimension of the mounting brackets and a material thickness of the bumpers.

In an embodiment having one more features of the elevator system of any of the previous paragraphs, the width of at least one of the bumpers overlaps with the width of at least one other of the bumpers.

In an embodiment having one more features of the elevator system of any of the previous paragraphs, the at least one of the bumpers is situated vertically above the at least one other of the bumpers.

In an embodiment having one more features of the elevator system of any of the previous paragraphs, the hoistway includes a plurality of hoistway doors at a corresponding plurality of locations along the length of the hoistway, each of the hoistway doors has an associated door lock, at least one of the hoistway liner bumpers is situated near a top of one of the hoistway doors and the associated door lock, the at least one of the hoistway liner bumpers is moveable between a first, protective position and a second, retracted position, in the first, protective position the at least one of the hoistway liner bumpers prevents contact between the load bearing assembly and the door lock, and in the second, retracted position the at least one of the hoistway liner bumpers allows the elevator car to move into a position where car doors on the elevator car can be coupled with the hoistway doors.

In an embodiment having one more features of the elevator system of any of the previous paragraphs a controller determines when to move the at least one of the hoistway liner bumpers into the second, retracted position based on a position of the elevator car within the hoistway.

In an embodiment having one more features of the elevator system of any of the previous paragraphs, the at least one hoistway liner assembly comprises a plurality of hoistway liner assemblies at respective selected vertical locations in the hoistway.

In an embodiment having one more features of the elevator system of any of the previous paragraphs, there is a vertical spacing between adjacent ones of the selected vertical locations and the vertical spacing is at least about 50 meters.

In an embodiment having one more features of the elevator system of any of the previous paragraphs, the vertical spacing is about 100 meters.

In an embodiment having one more features of the elevator system of any of the previous paragraphs, the hoistway liner assembly is collectively situated at a vertical location that is below a vertical midpoint of the hoistway.

In an embodiment having one more features of the elevator system of any of the previous paragraphs, the hoistway liner assembly includes at least one intermediate bumper situated in a space between a first portion of the load bearing assembly that moves in a first direction with the elevator car and a second portion of the load bearing assembly that moves in a second, opposite direction with the counterweight, and the at least one intermediate bumper establishes a barrier between the first and second portions of the load bearing assembly at a location of the intermediate bumper.

In an embodiment having one more features of the elevator system of any of the previous paragraphs, the at least one intermediate bumper comprises a plurality of intermediate bumper rollers supported on a bracket, one of the intermediate bumper rollers is situated at least partially above the bracket, another one of the intermediate bumper rollers is situated at least partially below the bracket, and an axis of the at least one of the bumpers is laterally offset from an axis of the at least one other of the bumpers.

In an embodiment having one more features of the elevator system of any of the previous paragraphs, the elevator system comprises at least one other vertically extending member associated with the elevator car, the at least one other vertically extending member is at least partially moveable with the elevator car, and the hoistway liner assembly prevents contact between the at least one other vertically extending member and the interior border of the hoistway at the vertical location.

In an embodiment having one more features of the elevator system of any of the previous paragraphs, at least one of the bumpers is moveable between a first, protective position and a second, retracted position, and the first protective position is located closer to a center of the hoistway than the second, retracted position.

In an embodiment having one more features of the elevator system of any of the previous paragraphs, the plurality of bumpers includes a plurality of sets of bumpers, each set has at least two bumpers that have axes that are not parallel to each other, the at least two bumpers of each set have vertical spacing between them along the vertical height of the hoistway.

In an embodiment having one more features of the elevator system of any of the previous paragraphs, the at least two bumpers of each set have portions overlapping each other to establish a portion of the protected area wherein any of the elongated members of the load bearing assembly can transition from contact with one of the at least two bumpers to contact with the other of the at least two bumpers without moving into a spacing between the portions overlapping each other.

In an embodiment having one more features of the elevator system of any of the previous paragraphs, the plurality of bumpers includes at least three bumpers and the at least three bumpers are associated with respective, different ones of the stationary boundaries.

In an embodiment having one more features of the elevator system of any of the previous paragraphs, the protected area surrounds the load bearing assembly.

In an embodiment having one more features of the elevator system of any of the previous paragraphs, the plurality of bumpers includes at least one bumper having its axis aligned with the width of each of the stationary boundaries.

Various features and advantages of at least one disclosed example embodiment will become apparent to those skilled in the art from the following detailed description. The drawings that accompany the detailed description can be briefly described as follows.

DETAILED DESCRIPTION

Figure 1:
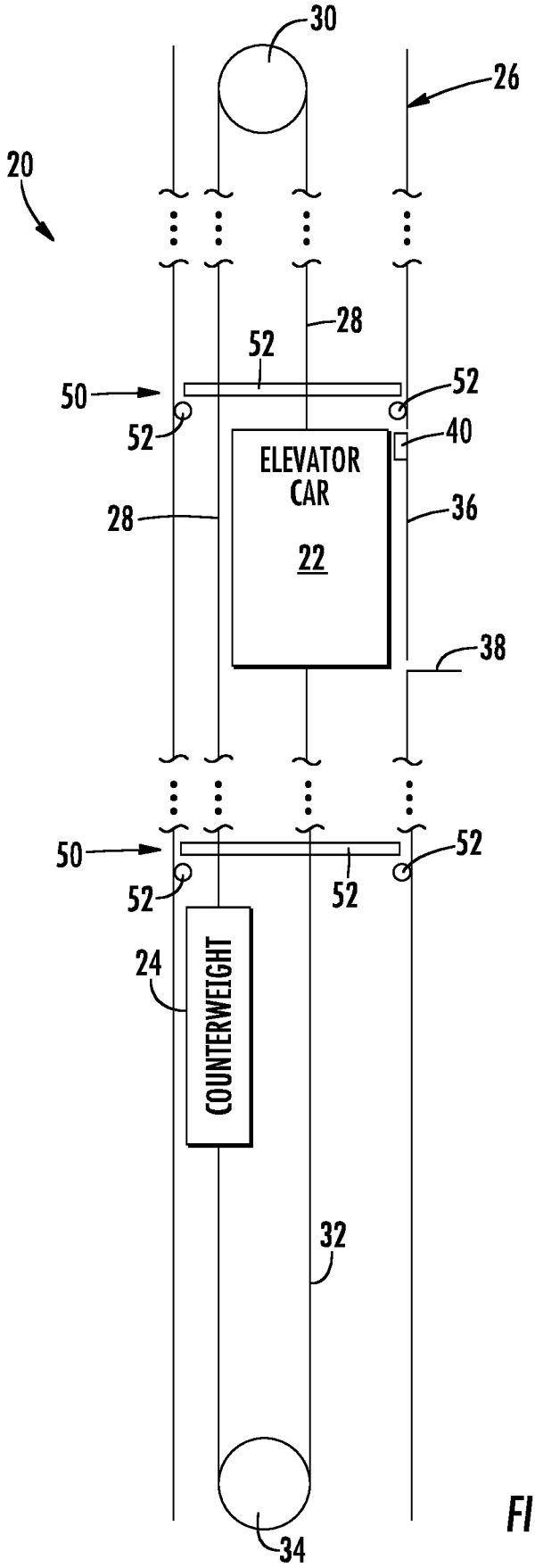
FIG. 1 schematically illustrates selected portion of an elevator system designed according to an embodiment of this invention.

FIG. 1 schematically illustrates selected portions of an elevator system 20 including an elevator car 22 and a counterweight 24 within a hoistway 26. In this example, the hoistway 26 is within an ultra-high rise building having a height on the order of 200 to 1000 meters. Another elevator system configuration that does not include a counterweight, such as a drum machine configuration, is used in other embodiments. Various elevator system configurations may include a protective hoistway liner assembly designed according to an embodiment of this invention.

In the illustrated example, a roping or load bearing assembly 28 couples the elevator car 22 to the counterweight 24. The load bearing assembly 28 includes a plurality of load bearing members, such as steel ropes or load-bearing belts, that suspend the load of the elevator car 22 and the counterweight 24. A traction machine 30 includes a traction sheave that causes selective movement of the load bearing assembly 28 to cause selective movement of the elevator car 22. The ropes or belts of the load bearing assembly 28 are elongated, vertically extending members within the hoistway 26.

A compensation roping assembly 32 couples the counterweight 24 and the elevator car 22 and wraps partially around a compensation sheave 34 to provide compensation in a known manner.

The hoistway 26 includes a plurality of landings and doorways for passengers to enter or exit the elevator car 22. For simplicity, FIG. 1 includes only one set of hoistway doors 36 associated with a landing 38. Those skilled in the art will realize that many more hoistway doors and landings would be included along a hoistway 26, especially in an ultra-high rise building. A door lock mechanism 40 is associated with the hoistway doors 36 to prevent those doors from being opened unless the elevator car 22 is appropriately positioned at the landing 38.

At least one hoistway liner assembly 50 is situated at a selected vertical height within the hoistway 26. The hoistway liner assembly 50 includes a plurality of bumpers 52. The hoistway liner assembly 50 establishes a barrier on an interior border of the hoistway at the vertical location of the hoistway liner assembly.

The illustrated elevator system 20 includes a plurality of hoistway liner assemblies 50. Only two hoistway liner assemblies 50 are shown in FIG. 1 for simplicity. The vertical locations for the hoistway liner assemblies may be separated by distances on the order of 50 meters. In some examples, a hoistway liner assembly is provided at about every 100 meters along the interior of the hoistway 26.

Some example embodiments will include a single hoistway liner assembly 50 within the hoistway. In such embodiments, the hoistway liner assembly 50 preferably is located below the vertical midpoint of the hoistway 26.

Figure 2:
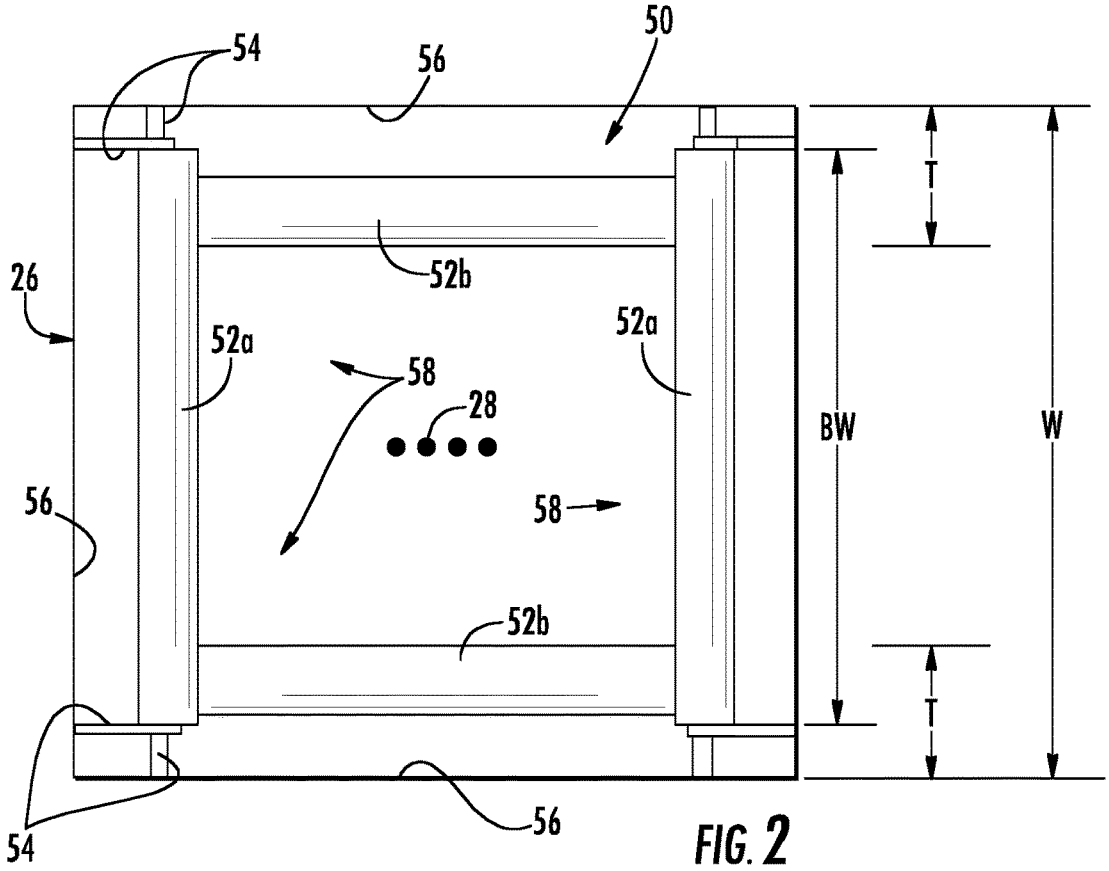
FIG. 2 schematically illustrates an example hoistway liner assembly as seen from above in planar view.
Figure 3:
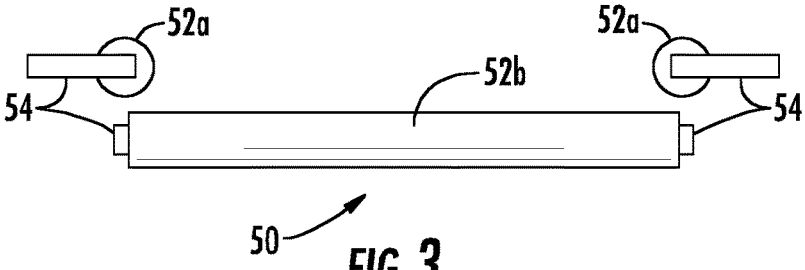
FIG. 3 illustrates the example hoistway liner assembly of FIG. 2 as seen from one side in planar view.

FIGS. 2 and 3 show an example hoistway liner assembly configuration from a top view and side view, respectively. In this example, the plurality of bumpers 52 comprise rollers supported on brackets 54, which are secured to walls 56 of the hoistway or to another stationary structure within the hoistway, such as a guiderail. The brackets 54 support the rollers 52 in a manner that allows the rollers 52 to freely rotate. In this example, two of the rollers 52A are situated vertically above the other two rollers 52B such that the rollers collectively surround or envelop a protected area 58 that contains the load bearing assembly 28. The protected area 58 is large enough that the elevator car 22 can move through it without contacting the bumpers 52. Providing sufficient space for elevator car movement within the protected area 58 allows the protection provided by the bumpers 52 to be available consistently, which is superior to an arrangement that requires protective or sway damping members that move into the pathway of the elevator car during temporary sway conditions. The illustrated embodiment provides protection in the protected area 58 during static or steady-state building drift conditions and temporary sway conditions.

The bumpers 52 collectively span across the width of a sufficient number of the walls 56 of the hoistway 26 for preventing contact between the load bearing assembly 28 and the interior border of the hoistway if the load bearing assembly 28 moves laterally within the hoistway 26 along at least two generally perpendicular directions. For example, if the height of the hoistway 26 is considered a z axis of a Cartesian coordinate system, then the hoistway liner assembly 50 protects the load bearing assembly 28 if it moves laterally along the x or y axis of the reference coordinate system. In one embodiment, the protected area 58 provides protection for the load bearing assembly 28 if the load bearing assembly moves laterally in a side-to-side or a front-to-back direction relative to the side of the hoistway 26 that includes the hoistway doors 36. In some embodiments the presence of bumpers 52 aligned with at least two of the walls 56 of the hoistway 26 will provide adequate protection. In other embodiments the bumpers 52 collectively span across the width of at least three of the walls 56 of the hoistway 26. The illustrated embodiments have a portion of the hoistway liner assembly 50 situated across all walls of the hoistway 26.

The terms "wall" and "walls" as used in this document should not be construed strictly. Various structures within the hoistway may be included as part of a wall, such as spreader beams and other support structures. The walls are stationary boundaries along the pathway of the elevator car. The interior border of the hoistway 26 in this example is defined by the interior surfaces of the walls 56 of the hoistway. The interior border of the hoistway may be considered to include other structures within the hoistway that are in a position where such other structures may be contacted by the load bearing assembly 28 under certain conditions.

One aspect of the arrangement of the rollers 52 in the embodiment of FIGS. 2 and 3 is the overlap among the rollers for surrounding the protected area 58 at the vertical location of the hoistway liner assembly 50. The overlap between the rollers 52 sufficiently contains or establishes a border around the area 58 in a manner that prevents the load bearing assembly 28 or any of its load bearing members from leaving the protected area 58 and making contact with the interior border of the hoistway 26 in at least that vertical location. The overlap between rollers in some embodiments includes overlap between portions of two or more rollers that are parallel with each other and aligned with one of the hoistway walls. Such overlap allows for the bumpers or rollers 52 to be shorter than the corresponding wall width and still provide protection across the entire width.

As shown in FIG. 2, the hoistway walls 56 have an interior width dimension W. In this example, the interior border of the hoistway 26 has a perimeter corresponding to the interior surfaces of the walls 56. The bumpers 52A have a bumper width BW, which is less than the width W of the hoistway wall 56. An effective thickness T of the bumpers 52B is a dimension that the bumpers 52B are spaced inwardly and away from the interior surface on the walls 56. The bumper width BW is at least as large as the dimension that is equal to the difference between the width W and the effective thickness T. That way, the bumper having the width BW spans across the width W of a wall 56 sufficiently to establish a barrier along that wall inside of the hoistway interior border.

The overlap among the rollers 52A and 52B in FIGS. 2 and 3 is accomplished by situating the rollers 52A above the rollers 52B at the selected vertical location. The overlap feature prevents any member (e.g., a belt or rope) of the load bearing assembly from moving into a position between the rollers.

Figure 4:
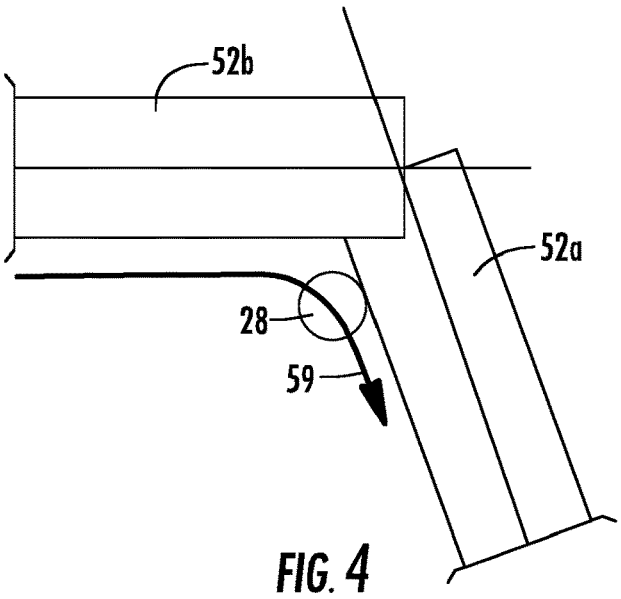
FIG. 4 illustrates a feature of an example embodiment of a hoistway liner assembly.

FIG. 4 illustrates two example rollers 52A and 52B with axes situated at an oblique angle relative to each other. A rope of the load bearing assembly 28 is approaching the interior surface or wall of the hoistway and contacts the rollers. The movement of the rope 28 schematically represented by the arrow 59 shows a transition from one of the rollers 52B to the other of the rollers 52A. The overlap ensures such a transition among or between bumpers of the hoistway liner assembly 50 without allowing the rope 28 to fit between any of the bumpers and the hoistway interior. The overlap prevents the rope 28 from getting snagged or otherwise caught between the rollers or within any spacing between the rollers and the hoistway interior. In other words, the overlapped arrangement of the rollers 52 allows for such lateral, transitional movement of the load bearing assembly 28 while keeping the load bearing assembly 28 within the protected space 58.

Figure 5:
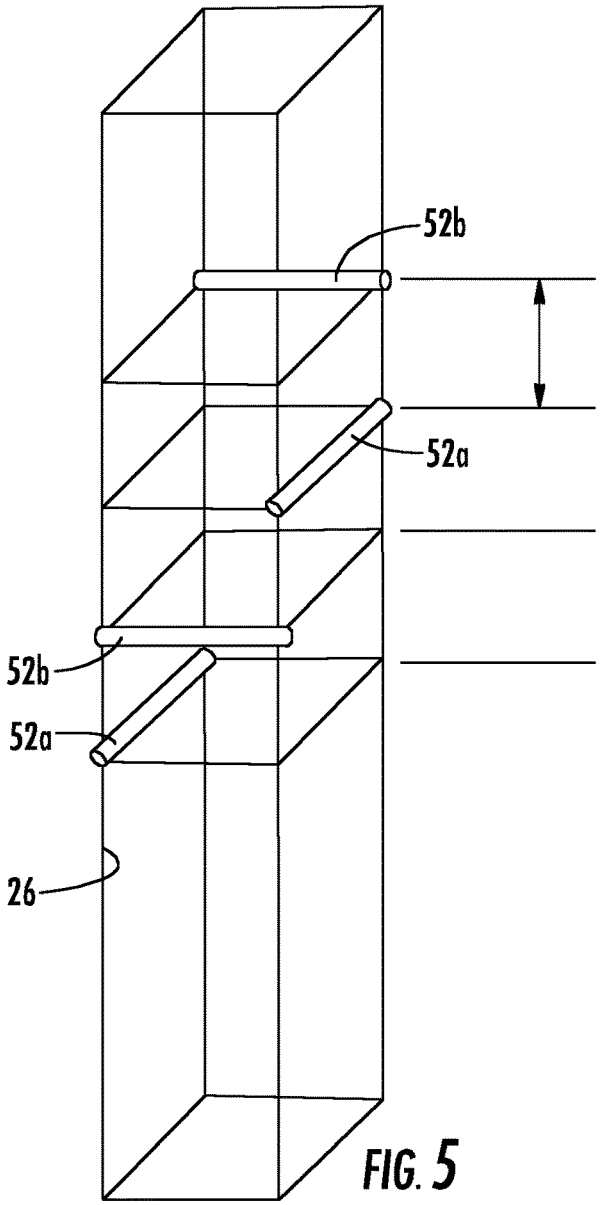
FIG. 5 illustrates a feature of another example embodiment of a hoistway liner assembly.

FIG. 5 illustrates a feature of an example embodiment in which the bumpers 52 of the hoistway liner assembly are distributed within the hoistway with vertical spacing between them that is large than that shown in FIG. 3, for example. In this embodiment, the individual rollers are approximately 3 meters (or 10 feet) apart in the vertical direction. The overlap feature discussed above is included in this embodiment and even with the vertical spacing shown in FIG. 5, the bumpers 52 provide safe, protected transitional movement among the bumpers or rollers 52 while keeping the load bearing assembly in the protected area 58.

Various vertical spacings and relative orientations of bumpers are possible in a hoistway liner assembly 50 designed according to this invention. Those skilled in the art who have the benefit of this description will be able to realize how to situate the components of a hoistway liner assembly 50 to meet the needs of their particular situation. For example, it is possible to model expected lateral movement behavior of a vertically extending member such as a load bearing member in a particular building and to select appropriate spacings of bumpers designed according to an embodiment of this invention to avoid contact between the vertically extending member and the interior of the hoistway even if there is lateral displacement of that member from an intended vertical path or position.

Figure 6:
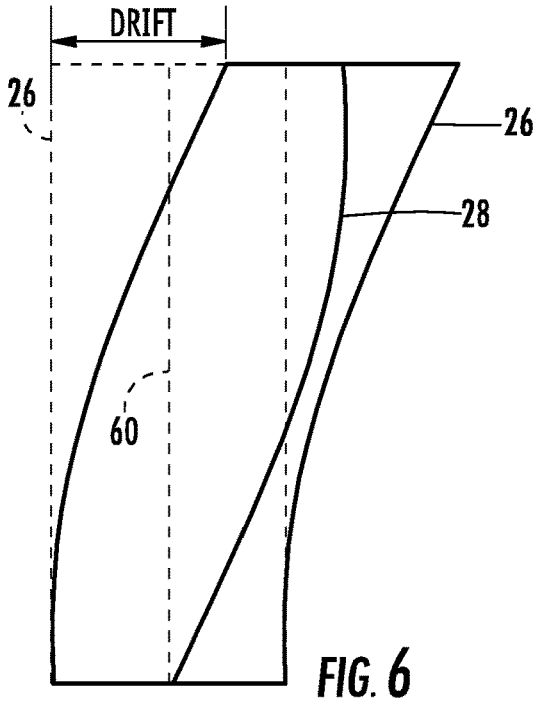
FIG. 6 schematically illustrates elevator roping behavior resulting from building drift.

FIG. 6 schematically illustrates a building condition in which there is static drift of an upper portion of the building relative to a lower portion of the building. The hoistway 26 has a vertically plum design orientation shown in phantom in FIG. 6. Because of environmental conditions or other factors, a static drift of the building results in a deviation of the actual position of the hoistway 26 from the designed orientation.

As designed, the load bearing assembly 28 follows a travel path schematically shown at 60, which is defined by the location of sheaves within the hoistway 26, for example. When there is building drift as schematically shown in FIG. 6, the load bearing assembly 28 tends to deviate from the design path 60 because of, for example, the effect of gravity on the elongated load bearing members of the load bearing assembly (or roping) 28. Under some such conditions, one or more sections of the load bearing assembly 28 may come into contact with the interior border of the hoistway 26. The hoistway liner assemblies 50 are situated at selected vertical positions within the hoistway to prevent contact between the load bearing members of the load bearing assembly 28 and the interior border of the hoistway 26, which corresponds to the interiorly facing surfaces of the hoistway walls in some examples.

The rollers 52 in the illustrated example embodiment comprise a compressible material that at least partially absorbs an impact between the load bearing assembly 28 and the bumpers 52 when there is such contact. In some examples, the rollers 52 comprise polyurethane. In other examples, the rollers 52 comprise rubber. The material for the bumpers or rollers 52 preferably is wear resistant and provides some damping of the forces associated with impact or contact between the load bearing assembly 28 and the bumpers 52.

In one example, the rollers comprise cylinders that are rotatable about shafts or rods. The roller cylinders in one example embodiment have a diameter of about 150 mm with a central core that is hollow. The central core in some examples has a diameter of about 75 mm. A variety of bumper configurations are useful in hoistway liner assemblies designed according to an embodiment of this invention.

One feature of a hoistway liner assembly 50 designed according to an embodiment of this invention is that it is always in the selected vertical location of the hoistway and situated to permit movement of the elevator car 22 throughout the hoistway. This differs from some previously proposed roping sway mitigation devices that selectively projected outward toward the center of the hoistway for purposes of contacting the elevator roping to reduce oscillations during an earthquake, for example. The hoistway liner assemblies 50 provide superior protection for the load bearing assembly 28 under static building drift conditions because the bumpers do not need to move into or out of a position where they provide protection for the load bearing assembly 28 against undesired contact between any of the load bearing members and the interior border of the hoistway 26.

Figure 7:
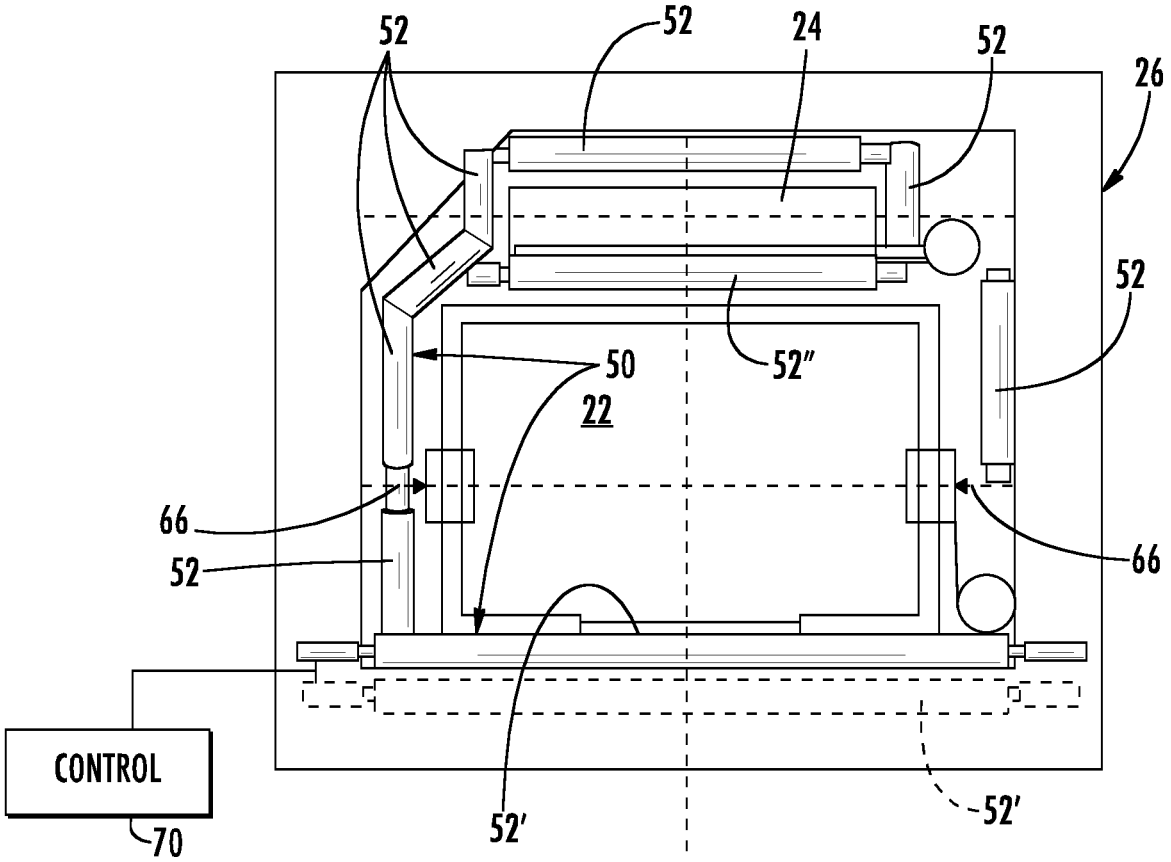
FIG. 7 schematically illustrates another example embodiment of a hoistway liner assembly seen from above in planar view.

FIG. 7 schematically illustrates an example arrangement of bumpers 52 of a hoistway liner assembly 50. In this example, more than one bumper or roller is associated with at least one of the interiorly facing walls of the hoistway 26. For example, on the left hand side of FIG. 7, two rollers 52 are oriented parallel to the left-most (according to the drawing) wall, which is the surface of the interior border of the hoistway 26 on that side. An elevator car guiderail 66 is situated between two bumpers 52 in this example. The bumpers 52 collectively span the width of the walls defining the interior border of the hoistway 26 without individually extending entirely across them in an uninterrupted fashion. The bumpers are situated to establish a barrier for preventing contact between the load bearing assembly 28 and the interior border of the hoistway at the vertical location of the hoistway liner assembly 50. Given other structural features of the example hoistway, the bumpers 52 are strategically positioned to provide the desired amount of protection.

One feature of the hoistway liner assembly 50 of the example of FIG. 7 is that it includes at least one bumper 52' that is selectively moveable between a first, protective position and second, retracted position. In the protective position, the roller 52' is situated further into the hoistway sufficiently to establish a barrier near a component or structure, such as the door lock 40 of an adjacent hoistway doorway, to prevent contact between any of the load bearing members of the load bearing assembly 28 and a component or structure (e.g., the door lock 40). Preventing contact at this location protects the integrity of such components or structures and the load bearing assembly 28.

Given the tight spacing constraints between the elevator car doors and the hoistway doors, the bumper 52' is retractable in a horizontally outward direction relative to a center of the hoistway 26. Moving the bumper 52' in this manner moves it out of the way of the elevator car 22 as the car approaches a landing near that bumper 52'. In this example, a controller 70 selectively causes movement of the bumper 52' into the second, retracted position based on information regarding the position of the elevator car 22. Many elevator systems include one or more devices for monitoring the position of the elevator car 22 within the hoistway. Such information may be provided to the controller 70 to allow the controller 70 to determine when to cause the bumper 52' to move into the second, retracted position. The controller 70 in one example includes a microprocessor that is programmed to determine an appropriate time for causing movement of the bumper 52'.

Another feature of the bumpers 52, 52' or 52" is that they are designed so that the roping or tension members 28 cannot move behind them into a position where the tension members would potentially get stuck.

Another feature of the example of FIG. 7 is that the hoistway liner assembly 50 includes at least one intermediate bumper 52" situated in a space between a first portion of the load bearing assembly 28 that moves in a first direction with the elevator car 22 and a second portion of the load bearing assembly 28 that moves in a second, opposite direction with the counterweight 24. The at least one intermediate bumper 52" prevents contact between the respective portions of the load bearing assembly 28 at the vertical location of the hoistway liner assembly 50. Another feature of the intermediate roller 52" is that it, in combination with other bumpers 52, establishes an area within which the portion of the load bearing assembly 28 that moves in the same direction as the counterweight 24 will be contained at the vertical location of the hoistway liner assembly 50.

Figure 8:
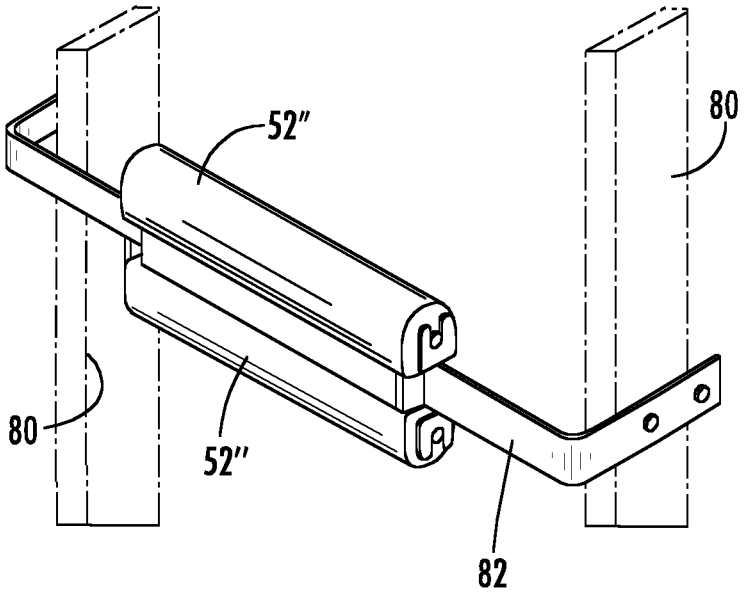
FIG. 8 schematically illustrates selected portions of the example hoistway liner assembly of FIG. 7.

FIG. 8 schematically illustrates an example arrangement of an intermediate bumper 52". In this example, counterweight guiderails 80 provide support to a mounting bracket 82. A plurality of rollers 52" are supported on the bracket 82 with one of those rollers 52" at least partially above the bracket 82 and another of those intermediate rollers 52" at least partially below the bracket 82. An arrangement of multiple rollers as shown in FIG. 6 ensures that the load bearing assembly 28 will not make contact with the bracket 82 under most expected building drift conditions.

The two tier bumper assembly in FIG. 8 can offer added protection between moving tension members, but also is useful if the bumper is a rotating device separating vertically extending members moving up on both sides of the rollers. To avoid one roller being contacted on both sides in this case, the top and bottom rollers are offset with a slight angle, which allows them each to spin in only one direction.

A hoistway liner assembly designed according to an embodiment of this invention allows for economically addressing a situation in which there may be static building drift that could affect the orientation and travel path of a load bearing assembly within an elevator system. Moreover, the hoistway liner assembly 50 provides protection for any elongated vertically extending member within an elevator system, such as the compensation roping assembly 32 or a traveling cable (not illustrated). The hoistway liner assembly 50 may remain in a single position within the hoistway and does not require any actuating mechanism for purposes of moving the bumpers into a protective position or out of the pathway of the elevator car or counterweight. The hoistway liner assembly 50 prevents any ropes, belts or cables extending vertically within the hoistway from contacting stationary hoistway equipment, devices or wall surfaces that might otherwise cause damage to such vertically extending members.

While the hoistway liner assemblies 50 are useful for static building drift or deflection conditions, they are also useful for periodic vibratory oscillations that may occur under certain high wind or earthquake conditions, for example.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

a hoistway that establishes a vertical pathway, the hoistway having an interior border established by a plurality of stationary boundaries that each have a height aligned with a vertical length of the hoistway, each of the stationary boundaries having a width generally perpendicular to the height;

an elevator car within the hoistway;

at least one vertically extending load bearing assembly including a plurality of elongated load bearing members, the load bearing assembly extending along a vertical path and facilitating movement or support of the elevator car; and at least one hoistway liner assembly situated in the hoistway, the hoistway liner assembly including a plurality of bumpers that each have an axis that is generally perpendicular to the vertical length of the hoistway, the axes of at least two of the bumpers are non-parallel, the bumpers collectively establishing a protected area sufficient for preventing contact between the load bearing assembly and the interior border of the hoistway if there is lateral movement of any of the load bearing members relative to the vertical path along at least two generally perpendicular directions; and wherein:

the hoistway liner assembly includes at least one intermediate bumper situated in a space between a first portion of the load bearing assembly that moves in a first direction with the elevator car and a second portion of the load bearing assembly that moves in a second, opposite direction with a counterweight; and the at least one intermediate bumper establishes a barrier between the first and second portions of the load bearing assembly at a location of the intermediate bumper.

2. The elevator system of claim 1, wherein the protected area surrounds the load bearing assembly;

the load bearing assembly may move laterally within the protected area toward the interior border of the hoistway; and the protected area is smaller than a hoistway area defined by the interior border of the hoistway.

3. The elevator system of claim 1, wherein the bumpers comprise rollers that comprise a compressible material that absorbs at least some of an impact associated with contact between the load bearing assembly and a contacted one of the rollers.

4. The elevator system of claim 3, wherein the rollers comprise at least one of rubber and polyurethane.

5. The elevator system of claim 1, wherein the bumpers respectively have an effective thickness that establishes a distance between an interior of the barrier established by the hoistway liner assembly and a respective one of the stationary boundaries;

the bumpers respectively have a bumper width that is generally perpendicular to the bumper thickness; and the bumper width of at least one of the bumpers is equal to a difference between the width of one of the walls and the thickness of at least one of the bumpers.

6. The elevator system of claim 5, wherein the hoistway liner assembly includes a plurality of mounting brackets that support the bumpers in respectively selected vertical locations; and the effective thickness is based on a dimension of the mounting brackets and a material thickness of the bumpers.

7. The elevator system of claim 5, wherein the width of at least one of the bumpers overlaps with the width of at least one other of the bumpers.

8. The elevator system of claim 1, wherein the hoistway includes a plurality of hoistway doors at a corresponding plurality of locations along the length of the hoistway;

each of the hoistway doors has an associated door lock;

at least one of the hoistway liner bumpers is situated near a top of one of the hoistway doors and the associated door lock;

the at least one of the hoistway liner bumpers is moveable between a first, protective position and a second, retracted position;

in the first, protective position the at least one of the hoistway liner bumpers prevents contact between the load bearing assembly and the door lock; and in the second, retracted position the at least one of the hoistway liner bumpers allows the elevator car to move into a position where car doors on the elevator car can be coupled with the hoistway doors.

9. The elevator system of claim 8, comprising a controller that determines when to move the at least one of the hoistway liner bumpers into the second, retracted position based on a position of the elevator car within the hoistway.

10. The elevator system of claim 1, wherein the at least one hoistway liner assembly comprises a plurality of hoistway liner assemblies at respective selected vertical locations in the hoistway.

11. The elevator system of claim 1, wherein the hoistway liner assembly is collectively situated at a vertical location that is below a vertical midpoint of the hoistway.

12. The elevator system of claim 1, wherein at least one of the bumpers is moveable between a first, protective position and a second, retracted position; and the first protective position is located closer to a center of the hoistway than the second, retracted position.

13. The elevator system of claim 1, wherein the plurality of bumpers includes a plurality of sets of bumpers;

each set has at least two bumpers that have axes that are not parallel to each other; and the at least two bumpers of each set have vertical spacing between them along the vertical height of the hoistway.

14. The elevator system of claim 13, wherein the at least two bumpers of each set have portions overlapping each other to establish a portion of the protected area wherein any of the elongated members of the load bearing assembly can transition from contact with one of the at least two bumpers to contact with the other of the at least two bumpers without moving into a spacing between the portions overlapping each other.

15. The elevator system of claim 1, wherein the plurality of bumpers includes at least three bumpers; and the at least three bumpers are associated with respective, different ones of the stationary boundaries.

16. The elevator system of claim 15, wherein the protected area surrounds the load bearing assembly.

17. The elevator system of claim 15, wherein the plurality of bumpers includes at least one bumper having its axis aligned with the width of each of the stationary boundaries.

18. The elevator system of claim 1, wherein the at least one intermediate bumper comprises a plurality of intermediate bumper rollers supported on a bracket;

one of the intermediate bumper rollers is situated at least partially above the bracket;

another one of the intermediate bumper rollers is situated at least partially below the bracket; and an axis of the at least one of the bumpers is laterally offset from an axis of the at least one other of the bumpers.

19. An elevator system, comprising:

a hoistway that establishes a vertical pathway, the hoistway having an interior border established by a plurality of stationary boundaries that each have a height aligned with a vertical length of the hoistway, each of the stationary boundaries having a width generally perpendicular to the height;

an elevator car within the hoistway;

at least one vertically extending load bearing assembly including a plurality of elongated load bearing members, the load bearing assembly extending along a vertical path and facilitating movement or support of the elevator car; and at least one hoistway liner assembly situated in the hoistway, the hoistway liner assembly including a plurality of bumpers that each have an axis that is generally perpendicular to the vertical length of the hoistway, the axes of at least two of the bumpers are non-parallel, the bumpers collectively establishing a protected area sufficient for preventing contact between the load bearing assembly and the interior border of the hoistway if there is lateral movement of any of the load bearing members relative to the vertical path along at least two generally perpendicular directions; and wherein:

the hoistway includes a plurality of hoistway doors at a corresponding plurality of locations along the length of the hoistway;

each of the hoistway doors has an associated door lock;

at least one of the hoistway liner bumpers is situated near a top of one of the hoistway doors and the associated door lock;

the at least one of the hoistway liner bumpers is moveable between a first, protective position and a second, retracted position;

in the first, protective position the at least one of the hoistway liner bumpers prevents contact between the load bearing assembly and the door lock; and in the second, retracted position the at least one of the hoistway liner bumpers allows the elevator car to move into a position where car doors on the elevator car can be coupled with the hoistway doors.

20. The elevator system of claim 19, wherein the hoistway liner assembly includes at least one intermediate bumper situated in a space between a first portion of the load bearing assembly that moves in a first direction with the elevator car and a second portion of the load bearing assembly that moves in a second, opposite direction with a counterweight; and the at least one intermediate bumper establishes a barrier between the first and second portions of the load bearing assembly at a location of the intermediate bumper.

21. The elevator system of claim 20, wherein the at least one intermediate bumper comprises a plurality of intermediate bumper rollers supported on a bracket;

one of the intermediate bumper rollers is situated at least partially above the bracket;

another one of the intermediate bumper rollers is situated at least partially below the bracket; and an axis of the at least one of the bumpers is laterally offset from an axis of the at least one other of the bumpers.

22. The elevator system of claim 19, wherein the elevator system comprises at least one other vertically extending member associated with the elevator car;

the at least one other vertically extending member is at least partially moveable with the elevator car; and the hoistway liner assembly prevents contact between the at least one other vertically extending member and the interior border of the hoistway at the vertical location.

23. The elevator system of claim 19, comprising a controller that determines when to move the at least one of the hoistway liner bumpers into the second, retracted position based on a position of the elevator car within the hoistway.

* * * * *